US006761578B1

(12) United States Patent
Stavely et al.

(10) Patent No.: US 6,761,578 B1
(45) Date of Patent: Jul. 13, 2004

(54) UNIVERSAL DOCKING TRAY USING THREE POINT CONTACTS

(75) Inventors: Donald J. Stavely, Windsor, CO (US); Amy E. Battles, Windsor, CO (US); Amol S. Pandit, Greeley, CO (US); Robert F. Yockey, Fort Collins, CO (US); Miles K. Thorland, Fort Collins, CO (US); Daniel J. Byrne, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/375,951

(22) Filed: Feb. 28, 2003

(51) Int. Cl.[7] ..... H01R 3/00
(52) U.S. Cl. ..... 439/489; 200/5 D; 710/303
(58) Field of Search ..... 439/489, 955, 439/49, 68, 71; 200/5 D, 5 R, 341; 710/303

(56) References Cited

U.S. PATENT DOCUMENTS 4,326,194 A * 4/1982 Pepe ..... 341/22
5,274,319 A * 12/1993 Keener et al. ..... 320/106
5,544,004 A * 8/1996 Inagaki et al. ..... 361/633
5,686,808 A * 11/1997 Lutz ..... 320/110
5,886,309 A * 3/1999 Hosogai et al. ..... 200/1 R
6,011,319 A * 1/2000 Kelly et al. ..... 307/10.1
2003/0000813 A1 * 1/2003 Roos ..... 200/1 R

* cited by examiner

*Primary Examiner*—Michael C. Zarroli

(57) ABSTRACT

Apparatus comprising an appliance having three appliance contacts disposed on its bottom surface and an appliance docking tray that allows transfer of power and data. The appliance docking tray has a grid of electrical contacts disposed on its top surface, and switching apparatus, such as a processor and switch matrix, coupled to the electrical contacts of the grid. The switching apparatus electronically switches between the electrical contacts to determine which of the electrical contacts touch the appliance contacts when the appliance is disposed on the top surface of the docking tray.

20 Claims, 1 Drawing Sheet

UNIVERSAL DOCKING TRAY USING THREE POINT CONTACTS

TECHNICAL FIELD

The present invention relates generally to dockable appliances or devices, and more specifically, to apparatus comprising an appliance docking tray and dockable appliance employing three point contacts that does not require physical alignment of the appliance to provide connections for power and data transfer.

BACKGROUND

Portable electronic appliances such as digital cameras and Personal Digital Assistants are more useful when they can connect to PC's, printers, TV's, kiosks, or other larger "fixed" devices. This can be accomplished with cable interfaces, such as USB, FireWire, or RS232. It can also be done wirelessly with infrared, Bluetooth, or 802.11.

Many of these portable appliances use rechargeable batteries that require them to be connected to a charger as well. It is often the user's routine to connect the portable appliance to the charger and to a PC whenever it is "home". Some appliances have integrated cables that connect to both charger and PC through a single connector.

A more elegant and convenient solution is to provide a dock or cradle that is semi-permanently wired to the "base" appliance. This dock also either contains, or is connected to, the battery charger. It is designed to conform to some physical feature(s) on the appliance in order to align their electrical connectors together as the user places the appliance in the dock.

The disadvantage of the dock concept is that it must be designed to accommodate the form factor of that particular portable device or appliance. It can only be used for other products if all of them were designed with the same alignment features. If these features are small and unobtrusive, then it is more difficult for the user to dock the appliance. If the alignment features conform to the appliance's shape, then it imposes those design constraints on all of the appliances.

What is needed is a dock that will work with a broad variety of electronic appliances, requires no effort from the user to align when docking, and imposes few if any constraints on the product design of the appliance.

Accordingly, it is an objective of the present invention to provide for an improved appliance and docking tray that overcomes the limitations of conventional devices. It is another objective of the present invention to provide for an appliance having three point contacts and cooperative appliance docking tray that requires no physical alignment of the appliance to provide connections for power and data transfer.

SUMMARY OF THE INVENTION

To accomplish the above and other objectives, the present invention provides for apparatus comprising an appliance having three point contacts and an improved appliance docking tray or "dock". The docking tray is used to connect the appliance to an external device, such as a computer, for example. The appliance has three point contacts that touch a coarse grid of contacts on the docking tray.

The dock is formed in the shape of a tray whose top surface comprises a coarse grid of metallic electrical contacts. The appliance is designed to have three point contacts or "feet" on its bottom surface. When the appliance is placed anywhere on the top surface of the docking tray, the three metallic feet contact at least three different electrical contacts of the grid on the top surface of the tray.

The three electrical contacts are sufficient to provide power to the appliance, and to exchange or transfer data. The dock comprises means, such as a switch and processor, for example, that electronically switches or selects, from all the contacts in the grid, those contacts that are touched by the feet of the appliance. Thus the dock can switch the power, ground, and data signals to whichever contacts on the grid are touched by the corresponding three contacts of the appliance.

In order to identify the location of the feet of the appliance on the contacts of the grid, the dock scans the grid electrically. The appliance is identified, for example, by its electrical impedance. In other words, the position of the appliance is known when current flows between the two appropriate grid contacts. The data contact is found by scanning the grid as well. The dock sends a query message to each contact until it gets a response.

BRIEF DESCRIPTION OF THE DRAWINGS

The various features and advantages of embodiments of the present invention may be more readily understood with reference to the following detailed description taken in conjunction with the accompanying drawings, wherein like reference numerals designate like structural elements, and in which.

DETAILED DESCRIPTION

Figure 1:
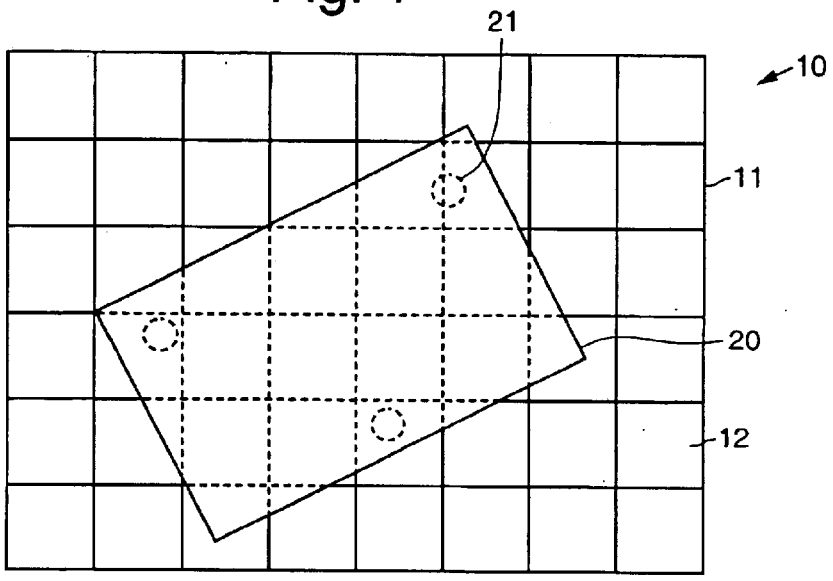
FIG. 1 illustrates a top view of a first exemplary embodiment of an appliance and docking tray in accordance with the principles of the present invention.
Figure 2:
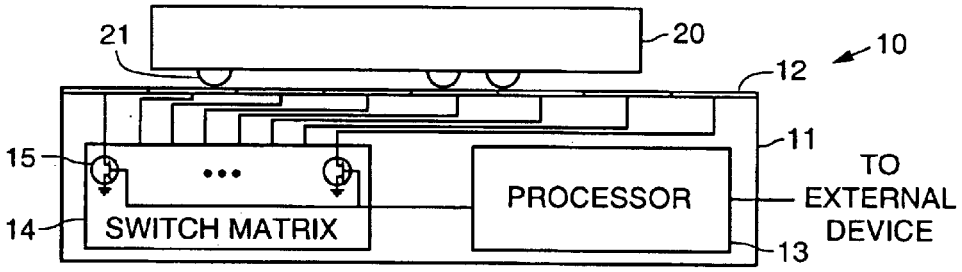
FIG. 2 illustrates a side view of the appliance and docking tray shown in FIG. 1.

Referring to the sole drawing figures, FIG. 1 illustrates a top view of a first exemplary embodiment of apparatus 10 in accordance with the principles of the present invention. FIG. 2 illustrates a side view of the apparatus 10.

The apparatus 10 comprises an appliance 20 and an appliance docking tray 11, or dock 11. The appliance 20 may be a digital camera or Personal Digital Assistant, for example. Any appliance 20 may be employed with the docking tray 11 that requires transfer of power and/or data to and/or from another device, such as a computer, for example.

The appliance 20 has three point contacts 21 (appliance contacts 21) or "feet" 21 located on its bottom surface. In the exemplary embodiment, two of the contacts 21 are power contacts 21, while the third contact 21 is a data transfer contact 21. The power contacts 21 are typically used to recharge a battery (not shown) disposed in the appliance 20.

The dock 11 is formed in the shape of a tray whose top surface comprises a coarse grid of metallic electrical contacts 12. When the appliance is placed anywhere on the top surface of the docking tray 11, the three metallic feet 21 contact or touch at least three different electrical contacts 12 of the grid of contacts 12 on the top surface of the docking tray 11.

The three electrical contacts 12 are sufficient to provide power to the appliance 20, and to exchange or transfer data.

The dock 11 comprises means or switching apparatus 13, 14, such as a switch 14 (or switch matrix 14) and processor 13, for example, that electronically switches or selects, from all the contacts 12 in the grid, those contacts 12 that are touched by the contacts 21 or feet 21 of the appliance 20. Thus the dock 11 can switch the power, ground, and data signals to whichever contacts 12 of the grid are touched by the corresponding three contacts 21 of the appliance 20. Alternatively, the processor 13 need not be present in the dock. If the dock is connected to a device such as a PC, its processor may be used to control to switching of the contacts 12.

In order to identify the location of the contacts 21 or feet 21 of the appliance 21 on the contacts 12 of the grid, the dock 11 scans the grid electrically. The appliance 20 is identified, for example, by its electrical impedance. The position of the appliance 20 is known when current flows between the two appropriate grid contacts 12. The data contact 21 is found by scanning the grid of contacts 12 as well. The dock 11 sends a query message to each contact 12 until it gets a response. Again, this process may be controlled by an internal processing element 13, by an external PC, or by some combination thereof.

The technique described above for scanning the grid of contacts 12 to find the appliance contacts 21 imposes no constraint on the position or spacing of the contacts 21 on the appliance 20, only that they be separated far enough that they touch separate grid contacts 12. The spacing of the grid contacts 12 must be sufficient so that an appliance contact 21 can short one grid contact to another without problems.

It is assumed above that the three appliance contacts 21 are allocated as: one for power, one for ground, and one for bidirectional data transfer. Other combinations are possible, such as modulating data or control signals "on top of the power voltage. Such schemes are well known in the art. It is thus possible to use only two of the "feet" 21 of the appliance 20 as electrical contacts 21, and have the third foot 21 be passive or non-operative.

If control and data is to be exchanged bidirectionally using a single contact 21, a "handshaking" protocol is required to avoid collisions or deadlocks between the appliance 20 and the dock 11. Again, such schemes are well understood by those skilled in the art.

The switching matrix is comprised of active devices for each signal at each grid contact 12. For example, a pull-down transistor may be provided for ground, a pull-up transistor may be provided for power, and a third transistor may be provided for data. Thus, complexity and cost increase with the size of the grid of contacts 12 on the dock 11. Such multiplexing and switching circuitry is well known in the industry. In addition, some simplification is possible with specific configurations.

Figure 3:
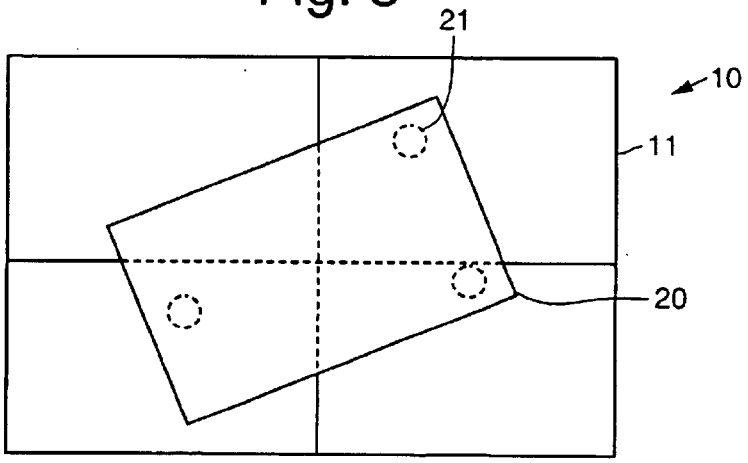
FIG. 3 illustrates a top view of a second exemplary embodiment of an appliance and docking tray in accordance with the principles of the present invention.

A large grid array of contacts 12 is only needed if the docking tray 11 is significantly larger than the appliance 20, and contact layout and spacing on the appliance 20 is unconstrained. The grid of contacts 12 can be very much smaller if the docking tray 11 imposes some very rough constraints on the appliance 20. For example, the configuration in FIG. 3 requires only four contacts 12. More particularly, FIG. 3 illustrates a top view of a second exemplary embodiment of apparatus 10 in accordance with the principles of the present invention. This configuration of the docking tray 11 allows the appliance 20 to be placed forwards or backwards, and accommodates a reasonable range of sizes and shapes of appliances 20.

Thus, an improved appliance docking tray and dockable appliance employing three point contacts has been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. Apparatus comprising:

an appliance comprising three appliance contacts disposed on one of its surfaces, which appliance contacts are used to transfer power and data; and an appliance docking tray comprising:

a grid of electrical contacts disposed on its top surface;

switching apparatus coupled to the electrical contacts of the grid for electronically switching between the electrical contacts to determine which of the electrical contacts touch the appliance contacts when the appliance is disposed on the top surface of the docking tray.

2. The apparatus recited in claim 1 wherein the switching apparatus comprises a processor coupled to a switch matrix.

3. The apparatus recited in claim 1 wherein the switching apparatus comprises a switch matrix that is controlled by the appliance to which the dock is connected.

4. The apparatus recited in claim 1 wherein the switching apparatus electrically scans the grid of electrical contacts to determine the location of the appliance contacts based upon electrical impedance.

5. The apparatus recited in claim 1 wherein the appliance comprises two power contacts and wherein the switching apparatus determines the location of the power contacts when current flows between the two appropriate grid contacts 12.

6. The apparatus recited in claim 4 wherein the appliance comprises a data contact and wherein the switching apparatus identifies the data contact by sending a query message to each contact until a response is received.

7. The apparatus recited in claim 4 wherein the appliance contacts comprise power and ground contacts, and a bidirectional data transfer contact.

8. The apparatus recited in claim 4 wherein the appliance contacts comprise a non-operative contact and power and ground contacts on which modulated data and/or control signals are transferred.

9. The apparatus recited in claim 1 further comprising a handshaking protocol that prevents data collisions during bidirectional exchange of control and data signals between the appliance 20 and appliance docking tray.

10. The apparatus recited in claim 8 wherein the switch matrix comprises an active device coupled to each grid contact.

11. The apparatus recited in claim 9 wherein the active devices comprise a pull-down transistor used for ground, a pull-up transistor used for power, and a third transistor used for data.

12. Apparatus comprising:

an appliance comprising a non-operative appliance contact and power and ground appliance contacts on which modulated data and/or control signals are transferred disposed on one of its surfaces; and an appliance docking tray comprising:

a grid of electrical contacts disposed on its top surface;

switching apparatus coupled to the electrical contacts of the grid for electronically switching between the electrical contacts to determine which of the electrical contacts touch the power and ground appliance contacts when the appliance is disposed on the top surface of the docking tray.

13. The apparatus recited in claim 12 wherein the switching apparatus comprises a processor coupled to a switch matrix.

14. The apparatus recited in claim 12 wherein the switching apparatus comprises a switch matrix that is controlled by the appliance to which the dock is connected.

15. The apparatus recited in claim 12 wherein the switching apparatus electrically scans the grid of electrical contacts 12 to determine the location of the appliance contacts based upon electrical impedance.

16. The apparatus recited in claim 12 wherein the appliance comprises two power contacts and wherein the switching apparatus determines the location of the power contacts when current flows between the two appropriate grid contacts.

17. The apparatus recited in claim 15 wherein the appliance comprises a data contact and wherein the switching apparatus identifies the data contact by sending a query message to each contact until a response is received.

18. The apparatus recited in claim 12 further comprising a handshaking protocol that prevents collisions during bidirectional exchange of control and data signals between the appliance docking tray.

19. The apparatus recited in claim 12 wherein the switch matrix comprises an active device coupled to each grid contact.

20. The apparatus recited in claim 19 wherein the active devices comprise a pull-down transistor used for ground, a pull-up transistor used for power, and a third transistor used for data.

* * * * *